US006899479B2

(12) United States Patent
Hayashi et al.

(10) Patent No.: US 6,899,479 B2
(45) Date of Patent: May 31, 2005

(54) PRINTER AND COMMODITY INFORMATION PROCESSING APPARATUS

(75) Inventors: Katsumune Hayashi, Suntou-gun (JP); Hiroyuki Koyama, Mishima (JP); Kouichi Yamada, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 24 days.

(21) Appl. No.: 10/660,028

(22) Filed: Sep. 11, 2003

(65) Prior Publication Data

US 2004/0096256 A1 May 20, 2004

(30) Foreign Application Priority Data

Sep. 12, 2002 (JP) ..... 2002-267213

(51) Int. Cl.[7] ..... B41F 11/26; B41F 11/27; B41F 11/30

(52) U.S. Cl. ..... 400/621; 400/605; 400/691; 400/690.4

(58) Field of Search ..... 400/621, 605, 400/690.4, 691

(56) References Cited

U.S. PATENT DOCUMENTS 5,137,385 A * 8/1992 Kamimura et al. ..... 400/690.4
5,833,380 A * 11/1998 Hosomi et al. ..... 400/621
5,902,059 A * 5/1999 Asai et al. ..... 400/605
6,443,645 B1 * 9/2002 Takei et al. ..... 400/621
6,447,187 B1 * 9/2002 Robinson ..... 400/621

FOREIGN PATENT DOCUMENTS

JP 10-337920 12/1998

* cited by examiner

*Primary Examiner*—Stephen R. Funk
*Assistant Examiner*—Marissa Ferguson
(74) *Attorney, Agent, or Firm*—Frishauf, Holtz, Goodman & Chick, P.C.

(57) ABSTRACT

A printer comprising a printing section that has a platen, a cutter section with a stationary blade and a movable blade and a printhead located oppositely on both sides of the guide path. A first unit is located on one side of the guide path arranged inside the casing which can be separated into a first casing member and a second casing member, holding either one of the stationary blade and the movable blade in the cutter section and a second unit located on the other side of the guide path that has either one of the other platen and the other printhead and either one of the other stationary blade and the other movable blade.

12 Claims, 11 Drawing Sheets

PRINTER AND COMMODITY INFORMATION PROCESSING APPARATUS

CROSS REFERENCE TO RELATED APPLICATION

The present application is based on Japanese Priority Document JP-2002-267213 filed on Sep. 12, 2002 the content of which is incorporated herein by reference.

BACKGROUND OF THE INVENTION

1. Field of the Invention

The present invention relates to a printer stored in a casing to print on paper and cut the paper after its printing, and a commodity information processing apparatus equipped with the printer.

2. Discussion of the Background

Conventionally, there has been adopted a printer in which a roll of paper as is used as a medium to be printed, and, after printing, the paper is cut off at an arbitrary position.

As an example of such a printer, there is a receipt printer which is incorporated in a commodity information processing apparatus such as a POS (Point Of Sales) terminal and an ECR (Electric Cash Register) and the like, and the printer issues a receipt on which specific data of transaction are printed to make clear details of the transaction by the sales-register processing.

The receipt is issued in accordance with details of transaction. Generally, therefore, the receipt differs in length every time it is issued. In the receipt printer, therefore, the paper is cut by a cutter section as required after printing of specific data, thereby enabling the use of a required length of paper without waste.

The conventional receipt printer stated above will be explained by referring to FIG. 13. A receipt printer 100 is of such a construction that, on a frame 108, are mounted a paper housing section 101 for housing and holding paper, a printing section 104 having a platen 102 which is driven to rotate and a printhead 103 located oppositely to the platen 102, and a rotary cutter 107 which is a cutting section having a stationary blade 105 and a movable blade 106 disposed oppositely to the stationary blade 105 and driven to rotate while sliding its cutting edge section in relation to that of the stationary blade 105.

The frame 108 is constructed such that a turning frame 110 is rotatably connected with respect to a main body frame 109 by a support shaft 111 arranged at the rear end of the printer.

Then, the receipt printer 100 is housed in the casing of the commodity information processing apparatus and used.

In the receipt printer 100 stated above, when printing is performed, first an opening/closing cover arranged at the casing of the commodity information processing apparatus is opened. Subsequently, the turning frame 110 is turned in a direction in which the turing frame 110 moves away from the main body frame 109, whereby the frame 108 is made open. Subsequently, a platen 102 is moved away from the printhead 103, and the stationary blade 105 is moved away from the fixed blade 106.

In this state, the paper 112 is housed in the paper housing section 101, the paper 112 is drawn out to pass over the main body frame 109, and in this state the turning frame 110 is turned in a direction in which it approaches to the main body frame 109. Then, the frame 108 is closed to cause the paper to be held between the platen 102 and the printhead 103 and between the stationary blade 105 and the movable blade 106.

After this state, the opening/closing cover arranged at the casing of the commodity information processing apparatus is closed. Then, a setting of the paper 112 to the receipt printer 100 is carried out.

In this way, the platen 102 is rotated and driven under a state in which the paper 112 is set, the paper 112 held by the paper housing section 101 is drawn out and transferred, some specific data are printed on the paper 112 by the printhead 103 during its transferring stage and the paper 112 after printed is cut by a rotary cutter 107, whereby a receipt is issued.

In this case, when the cutting operation of the rotary cutter 107 is carried out, a force in a direction moving away from the main body frame 109 may act on the turning frame 110. Although not shown in FIG. 13, the receipt printer 100 is provided with a turning operation restricting structure (not shown) for restricting a turning of the turning frame 110 under influence of this force.

In this receipt printer 100, the turning frame 110 is turned with respect to the main body frame 109 to enable the platen 102 and the printhead 103 to be moved away from each other and the stationary blade 105 and the movable blade 106 to be moved away from each other, so that a setting of the paper 12 and clearing of jam of the paper 112 between the platen 102 and the printhead 103 and between the stationary blade 105 and the movable blade 106 can be easily carried out.

However, in the case of such a receipt printer 100 as described above, the turning frame 110 having such a size ranging from the support shaft 111 installed at the rear end of the receipt printer 100 to the rotary cutter 107 arranged at the front end of the receipt printer 100 must be installed, whereby a weight of the receipt printer 100 is increased.

SUMMARY OF THE INVENTION

Accordingly, an object of the present invention is to make a lightweight structure for use in dividing the printing section and a cutter section.

The objects of the present invention are achieved by the novel printer and the commodity information processing apparatus of the present invention.

According to the novel printer and the commodity information processing apparatus of the present invention, a printing section has a platen and a printhead located oppositely on both sides of the guide path; in the printing section, a cutter section has a stationary blade and a movable blade located oppositely on both sides of the guide path and cuts paper printed at the printing section by engaging the movable blade with the stationary blade. A first unit is located on one side of the guide path arranged inside the casing which can be separated into a first casing member and a second casing member, holding either one of the stationary blade and the movable blade in the cutter section; and a second unit located on the other side of the guide path has either one of the other platen and the other printhead and either one of the other stationary blade and the other movable blade. Under a state in which the casing is closed, the printhead and the platen are oppositely arranged and the stationary blade and the movable blade are positioned at a location where the paper can be cut, and under a state in which the casing is opened, the second unit is directly mounted to a second casing member in such a way that the printhead and the platen are arranged away from each other and the stationary blade and the movable blade are arranged away from each other.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Referring now to FIGS. 1 to 11, one preferred embodiment of the present invention will be described. The present embodiment is an example of application in which the printer is applied to the ECR acting as the commodity information processing apparatus having the receipt printer stored therein.

Figure 1:
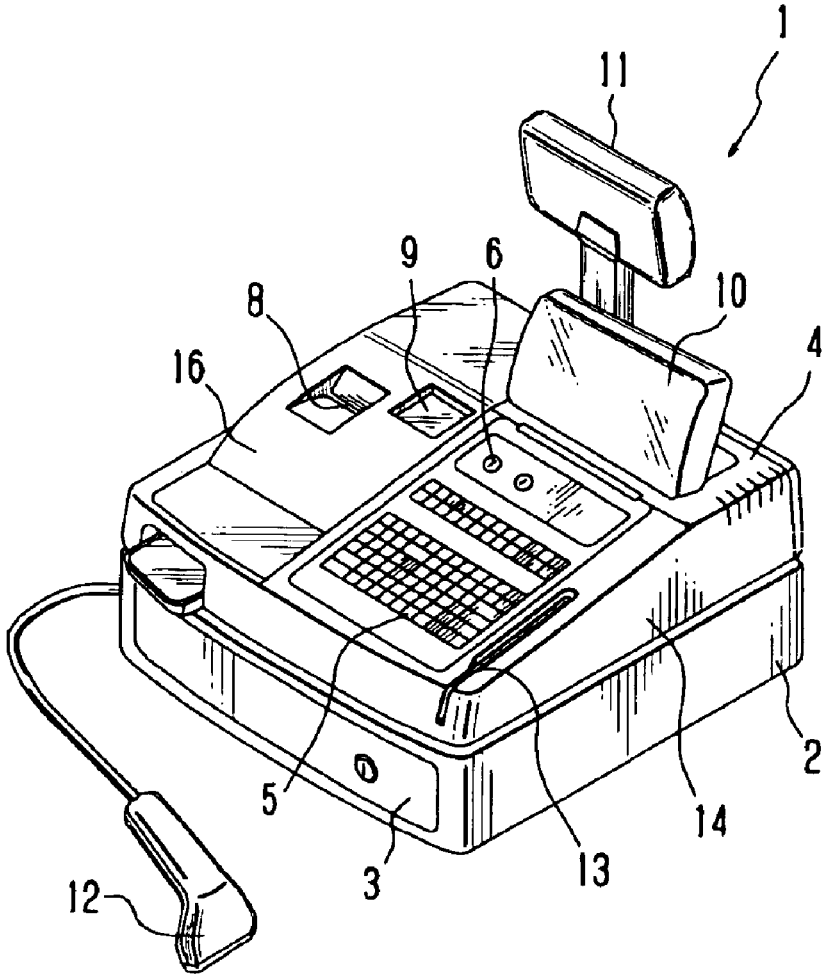
FIG. 1 is an outer appearance perspective view for schematically showing the ECR of a first preferred embodiment of the present invention; FIG.

FIG. 1 is an outer appearance perspective view for schematically illustrating the ECR of the present embodiment. As shown in FIG. 1, the ECR 1 of the present embodiment is mounted on a drawer unit 2 so as to control an opening or closing of a drawer 3 of the drawer unit 2. This ECR 1 is provided with a casing 4 for holding each of the sections of the ECR 1. This casing 4 is provided with a keyboard 5 having various kinds of keys collected, a control key 6 for use in switching and setting an operation mode of the ECR 1 to each of task modes such as a registration mode, a setting mode, a fare adjustment mode and an inspection mode and the like through application of keys not shown, a receipt issuing port 8 for issuing a transaction receipt or the like printed by the receipt printer 7 (refer to FIG. 2) and a journal window 9.

The receipt printer 7 is stored at a left side as seen in FIG. 1 inside the casing 4.

A display 10 acting as a display section at an operator's side is arranged above the right side of the ECR 1 in FIG. 1. A customer-side display 11 acting as a display section at the customer is vertically installed near the display 10.

To the ECR 1 is connected a bar-code scanner 12 for use in optically reading a commodity code attached to a commodity. In addition, a magnetic card reader 13 for use in reading data recorded in some magnetic stripes of a credit card (not shown) is installed at a right lower side of the ECR 1.

Figure 2:
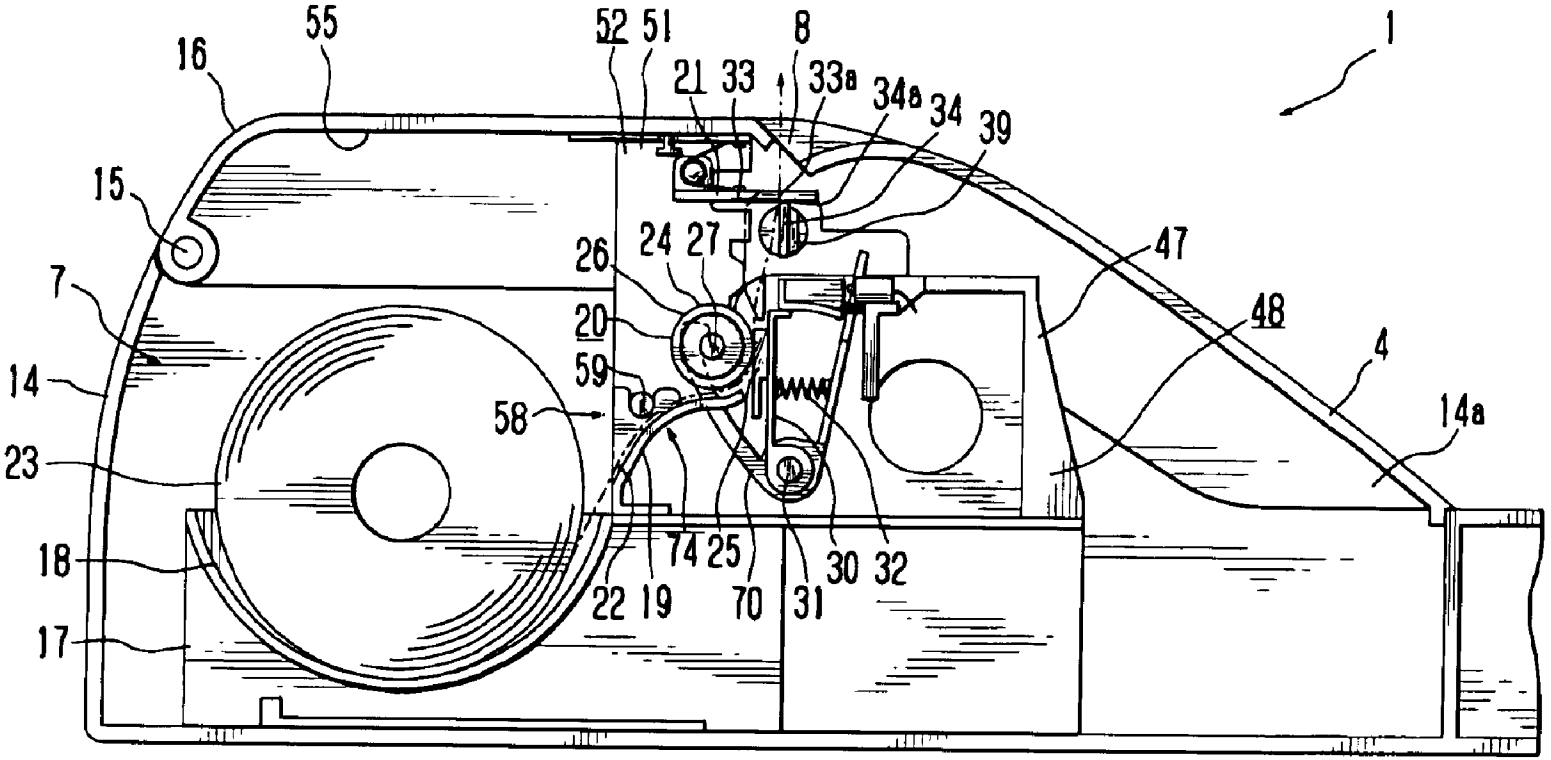
FIG. 2 is a longitudinal left side view showing the receipt printer stored in the ECR.
Figure 3:
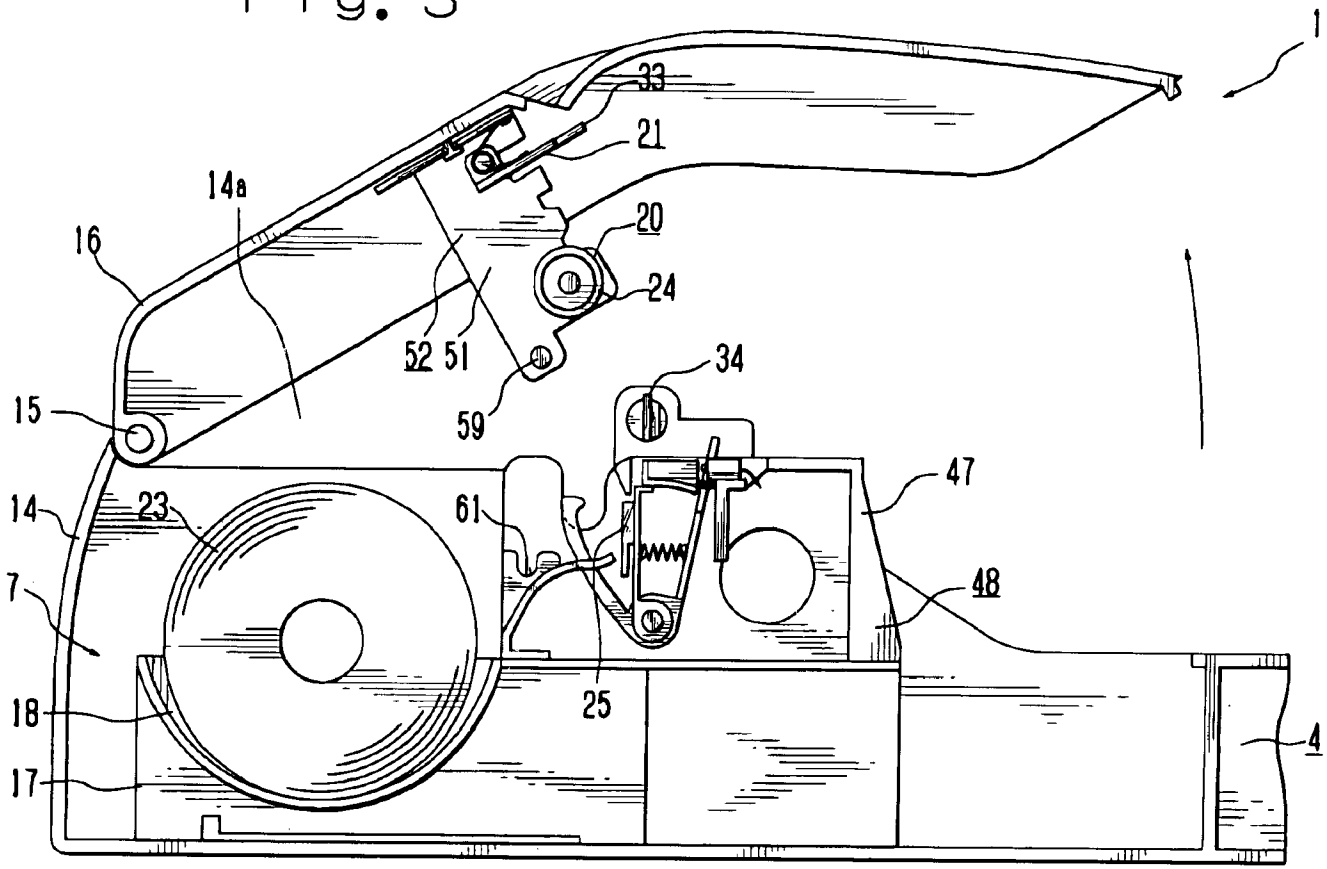
FIG. 3 is a longitudinal left side showing the ECR under a state in which an opening/closing cover is opened.

In this case, FIG. 2 is a longitudinal left side view showing the receipt printer 7 stored in the ECR 1. FIG. 3 is a longitudinal left side view showing the ECR with the opening/closing cover being opened. The casing 4 is constituted by a case 14 acting as a first casing member, and an opening/closing cover 16 acting as a second casing member fixed to the case 14, by a support shaft 15 in such a way that it can be opened or closed. The casing 4 of the present embodiment is a member constituting the outer-most shape (outer shape) of the printer 1. An opening 14*a* is formed above the receipt printer in the case 14. The opening/closing cover 16 is arranged to cover the opening 14*a*. The opening/closing cover 16 is rotatably arranged to the case 14 and the inside part of the casing 4 is opened or closed by a relative displacement of the opening/closing cover 16 in respect to the case 14 through turning of the opening/closing cover 16 in regard to the case 14. The opening/closing cover 16 is provided with the aforesaid receipt issuing port 8 and the journal window 9.

Next, a structure of the receipt printer 7 will be described. As shown in FIG. 2, a support frame 17, a paper-storing section 18, a paper guide 19, a printing section 20 and a cutter section 21 constitute the receipt printer 7. The paper-storing section 18 is set at the support frame 17. The receipt printer 7 is formed with a paper transfer path 22 acting as guide path starting from the paper-storing section 18 to the cutter section 21 through the printing section 20. The paper-storing section 18 is formed into an arcuate shape and stores and holds a rolled wound elongated paper 23. The paper guide 19 is formed between the front end of the paper-storing section 18 and the printing section 20 so as to support a surface of the paper 23.

The printing section 20 is constituted by a platen 24 and a thermal head 25 acting as a print head oppositely facing to this platen 24. The platen 24 is constituted by a paper support 26 supporting a rear surface of the paper 23 and a support shaft 27 formed to extend from both ends of the paper support 26.

Figure 4:
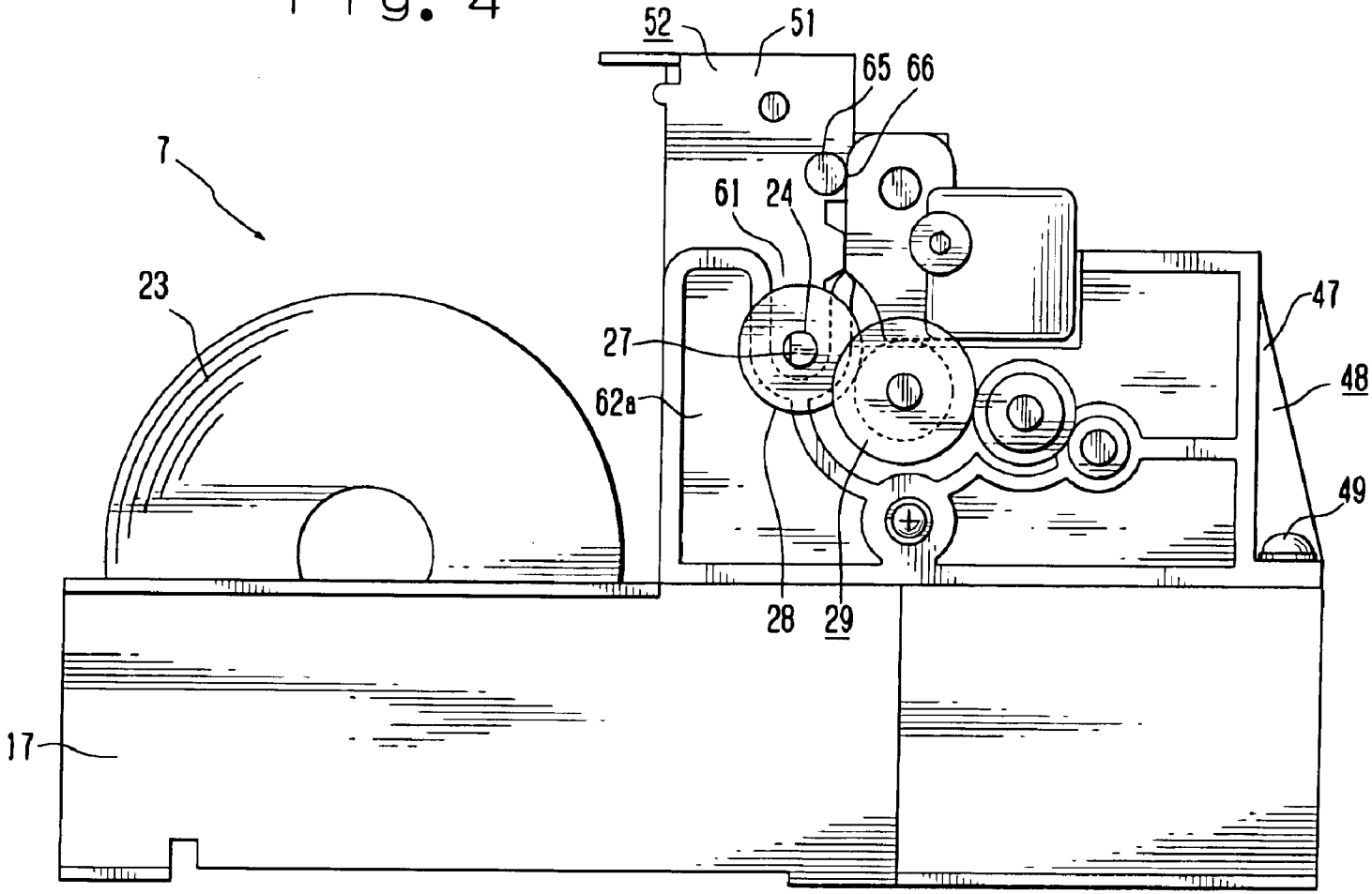
FIG. 4 is a left side view showing the receipt printer.

In this case, FIG. 4 is a left side view showing a receipt printer 7. As shown in FIG. 4, a gear 28 is fixed to the support shaft 27 at one end of the platen 24, and the platen 24 is connected to a motor not shown through the gear 28 and a gear train 29 engaged with the gear 28. A driving force applied from the motor transmitted through the gear 28 and the gear train 29 rotatably drives the platen 24. In the present embodiment, the gear 28 and the gear train 29 realize a driving force transmitting mechanism, and the motor realizes a driving source.

As shown in FIG. 2, the thermal head 25 is mounted to a head holding member 30 of flat-plate shape. This head holding member 30 is rotatably arranged in such a direction as one in which it is moved to or away from the platen 24 around a fulcrum 31, and urged to the platen 24 by a coil spring 32 arranged between the head holding member and a hook member 70 described later and acting as a compression spring. With this arrangement, the thermal head 25 abuts against the platen 24. Then, at the printing section 20, the thermal head 25 carries out a printing on the paper 23 placed between the platen 24 and the thermal head 25. In addition, the platen 24 is rotated and driven by the motor to cause the paper 23 to be transferred along the paper-carrying path 22. In this case, the printing section 20 may also act as a carrying section for carrying the paper 23.

The cutter section 21 has an assembly of a stationary blade 33, and a movable blade 34 either having a shape of approximately flat plate. These blades 33 and 34 are of a separated type, being kept open when not cutting. The stationary blade 33 and the movable blade 34 are so positioned as to engage with each other like scissors when the movable blade 34 is rotating. That is, the cutter section 21 of the present embodiment is a rotary cutter so constructed as to cut the paper 23 that is carried along the paper-carrying path 22, by engaging the stationary blade 33 with the movable blade 34 like a pair of scissors. A stepping motor (not shown) acting as a driving source drives the movable blade 34 of the cutter section 21 thus constructed. The stepping motor is started to operate in accordance with a start signal.

Figure 5:
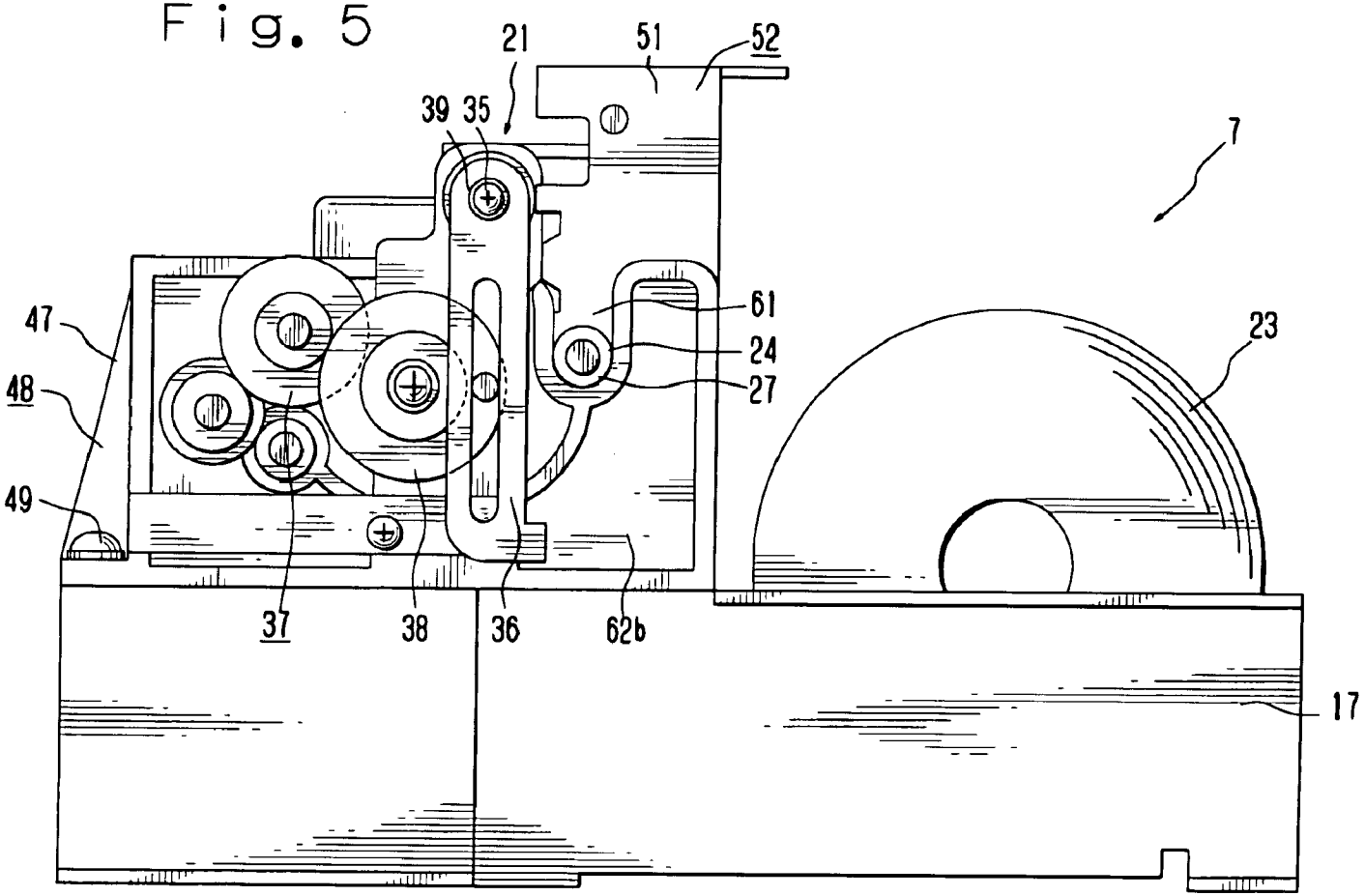
FIG. 5 is a right side view showing the receipt printer.

FIG. 5 is a right side view showing the receipt printer. As shown in FIG. 5, a cutter arm 36 that rocks on the center of a fulcrum 35 is connected to the movable blade 34. A driving force of the stepping motor stated above is transmitted to the cutter arm 36 via a plate cam 38 connected through a gear train 37. In the present embodiment, the driving force of the stepping motor is transmitted to the movable blade 34 through the cutter arm 36, the gear train 37 and the plate cam 38 as power transmission media, thereby driving to rotate the movable blade 34. Here the cutter arm 36 functions as a follower in a cam mechanism in which the plate cam 38 functions as a driver. In the present embodiment, when the cutter arm 36 rocks by a predetermined amount from a predetermined position, the movable blade 34 mounted on a rotating shaft 39 which is a movable blade holding section and is secured on the center of rotation thereof is rotated from a non-cutting position to a cutting position. Thus the paper 23 is cut by the stationary blade 33 and the movable blade 34 which are engaged like scissors.

Figure 6:
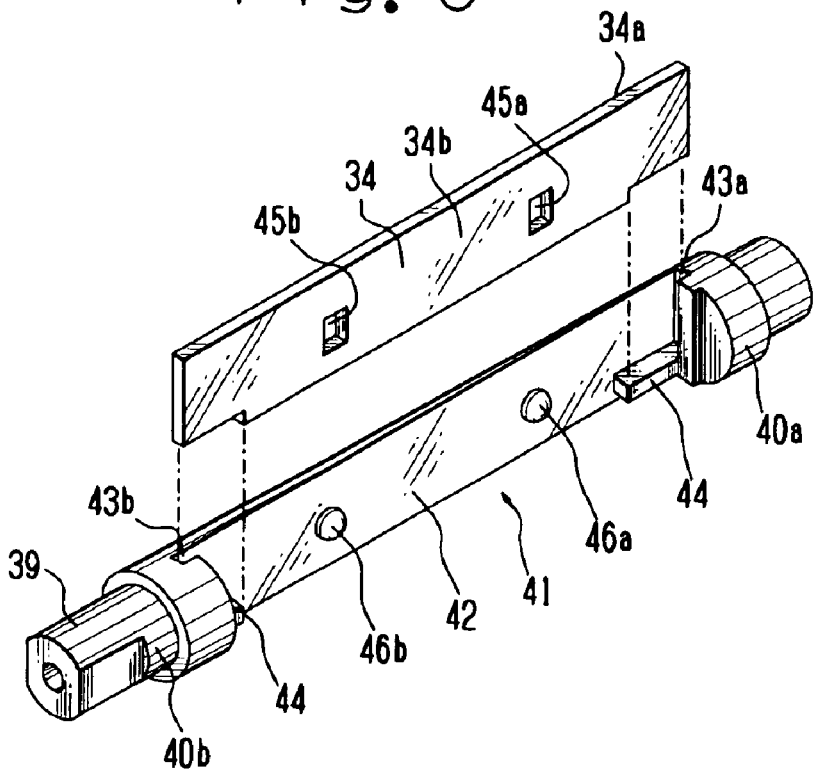
FIG. 6 is a perspective view showing a movable blade and a turning shaft.
Figure 7:
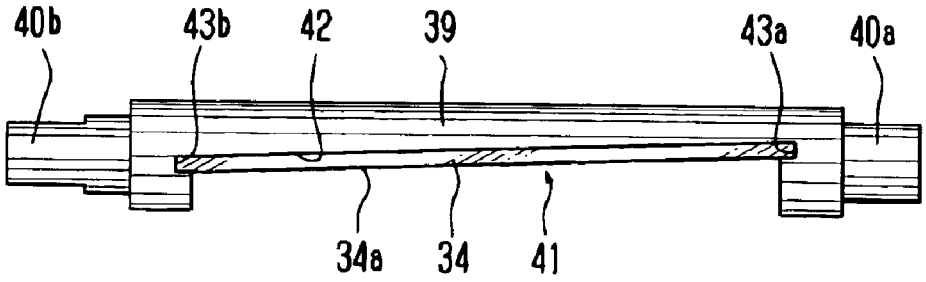
FIG. 7 is a top plan view showing a turning shaft under a state in which the movable blade is fixed.

FIG. 6 is a perspective view showing the movable blade and the rotating shaft. FIG. 7 is a plan view showing the rotating shaft mounted with the movable blade. The movable blade 34 is removably mounted on the rotating shaft 39 as shown in FIG. 6. The rotating shaft 39 is produced of an elastic resin, and formed in a shape of rod. Furthermore, the rotating shaft 39 is positioned in a direction in which its axis will be in parallel with the axis of the platen 24.

On both end portions of the rotating shaft 39, support portions 40*a* and 40*b* rotatably mounted on the lower unit frame 47 are formed. Between these two support portions 40*a* and 40*b*, a movable blade holding section 41 removably holding the movable blade 34 is formed. More specifically, the movable blade holding section 41 is formed to cut out stock between the support sections 40*a* and 40*b* in such a manner that the rotating shaft 39 will have a semi-circular cross section. Between the support sections 40*a* and 40*b*, a flat surface 42 is formed on the movable blade holding section 41. The flat surface 42 is inclined in relation to the direction of the axis of the rotating shaft 39.

Formed at both ends of the flat surface 42 inside the support sections 40*a* and 40*b* are grooves 43*a* and 43*b* in which both ends of the movable blade 34 can be slidably fitted. Therefore, the movable blade 34 fitted in the grooves 43*a* and 43*b* is inclined in relation to the direction of the axis of the rotating shaft 39 along the flat surface 42. In both ends of the lower edge portion of the flat surface 42, a positioning portion 44 is formed to support in position the lower edge of the movable blade 34 inserted in the grooves 43*a* and 43*b*.

In the base section 34*b* of the movable blade 34, two holes 45*a* and 45*b* are formed. On the flat surface 42 of the rotating shaft 39, two projections 46*a* and 46*b* are formed to fit in the holes 45*a* and 45*b*. The movable blade 34 is installed in such a manner that an edge portion 34*a* may protrude out of the outer peripheral surface of the rotating shaft 39, and that the bottom end (the opposite side of the edge portion 34*a*) of the base section 34*b* may be in the same position as that of the outer peripheral surface of the rotating shaft 39. The rotating shaft 39, therefore, can be reinforced by the movable blade 39, thereby maintaining the strength of whole body of the rotating shaft 39 even if the rotating shaft 39 is cut out into a semi-circular cross sectional form.

To mount the movable blade 34 to the movable blade holding section 41, the bottom end on the opposite side of the edge portion 34*a* of the movable blade 34 is inserted into the grooves 43*a* and 43*b*. The rotating shaft 39, having resilience, deflects to allow the projections 46*a* and 46*b* to fit in the holes 45*a* and 45*b*. In this state, the movable blade 34 thus fitted in the grooves 43*a* and 43*b* is sandwiched between the grooves 43*a* and 43*b* that have resilience. Thus fitting the projections 46*a* and 46*b* in the holes 45*a* and 45*b* can restrict the movement of the movable blade 34, holding the movable blade 34 on the rotating shaft 39. When removing the movable blade 34 from the rotating shaft 39, the movable blade 34 is pulled out of the grooves 43*a* and 43*b*, to thereby deflect the rotating shaft 39 to release the projections 46*a* and 46*b* from the holes 45*a* and 45*b*. It is, therefore, possible to remove the movable blade 34 from the grooves 43*a* and 43*b* of the rotating shaft 39.

Figure 8:
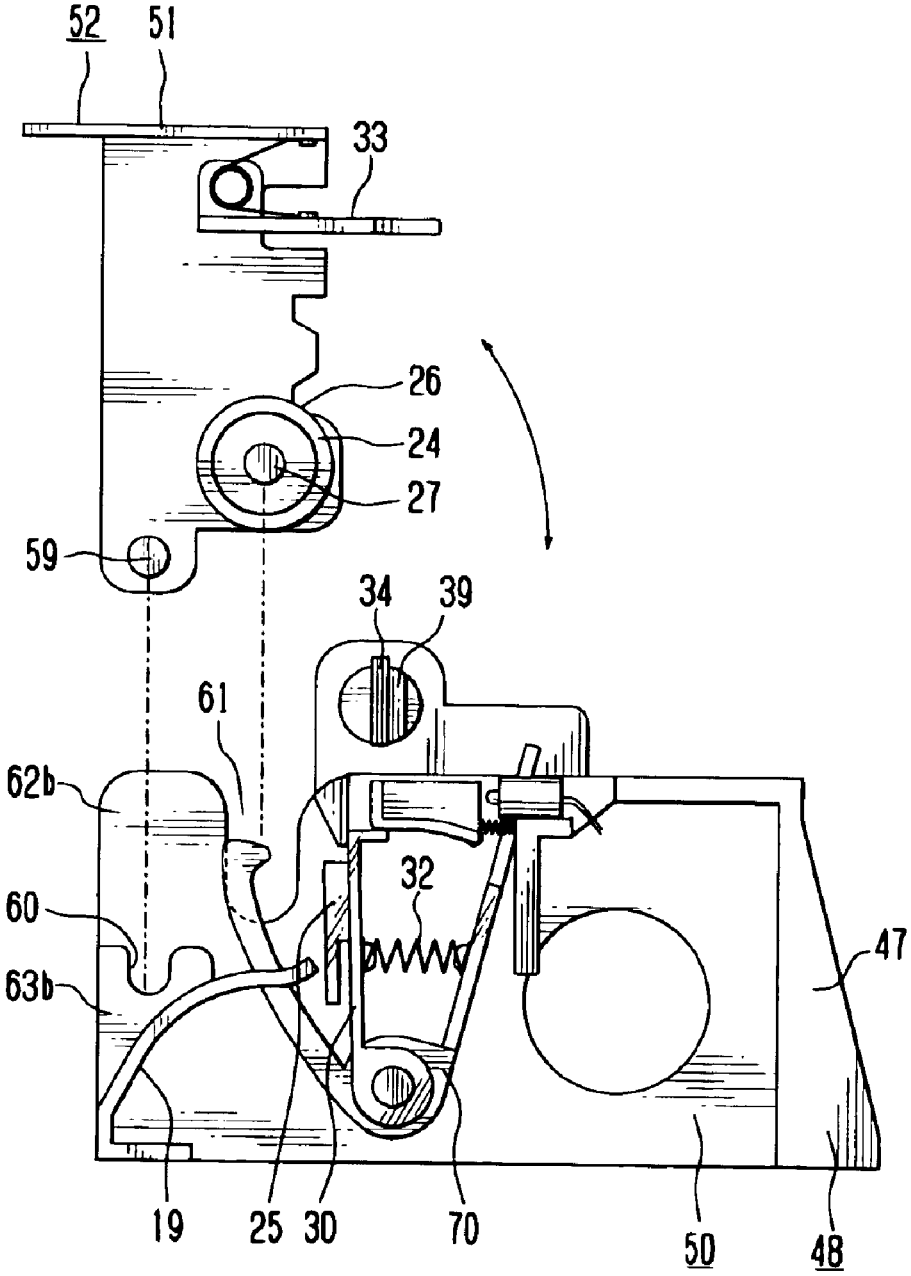
FIG. 8 is a longitudinal left side view showing an upper unit and lower unit under a state in which they are separated from each other.
Figure 9:
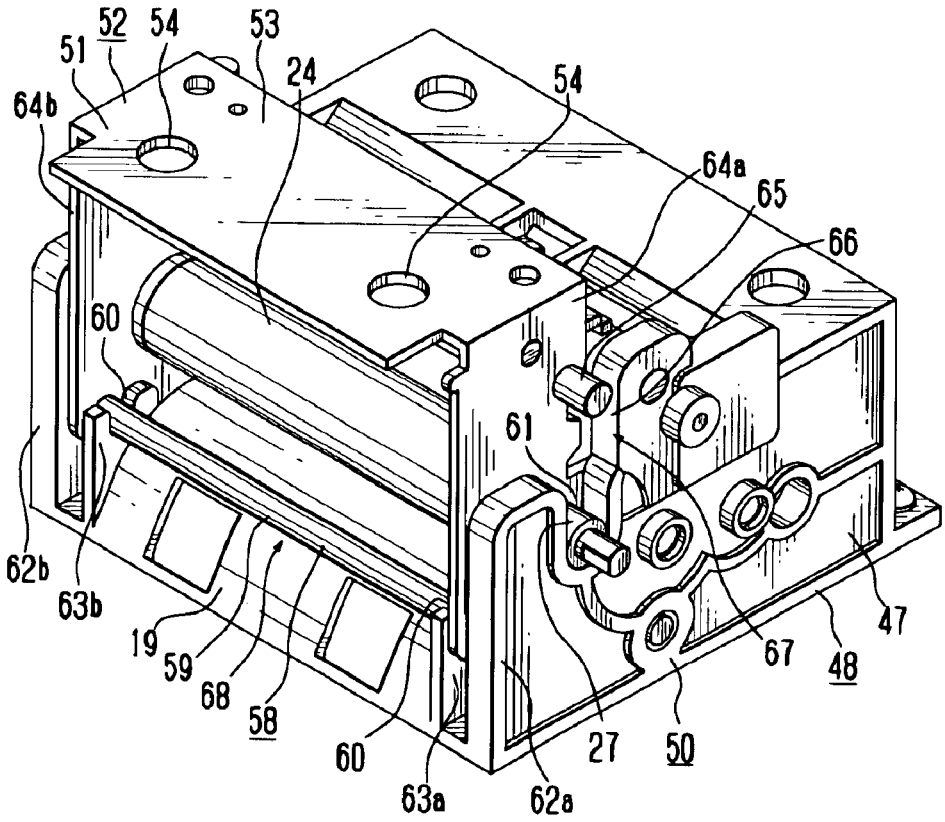
FIG. 9 is a perspective view showing an upper unit and a lower unit under a state in which they are connected to each other.

Next, FIG. 8 is a longitudinal left side view showing a printer unit of one embodiment of the present embodiment with an upper unit and a lower unit separated. FIG. 9 is a perspective view showing the printer unit of one embodiment of the present embodiment with the upper unit and the lower unit connected. As shown in FIG. 2, FIG. 8 and FIG. 9, the paper guide 19, the thermal head 25, the movable blade 34, the fulcrum 35, the cutter arm 36, the gear train 37, the plate cam 38, and the gear train 29 are mounted on the lower unit frame 47, forming the lower unit 48 which is the first unit.

The lower unit 48 is fitted with a screw to the support frame 17 through a threaded engagement of a screw 49. The lower unit 48 is arranged inside the casing 4 and fixed to the case 14 of the casing 4.

In turn, the platen 24 and the stationary blade 33 are installed at a turned square U-shaped upper unit frame 51 of lower opening independently arranged away from the lower unit frame 47, and these members constitute the upper unit 52 acting as a second unit. Further, a motor driving the movable blade 34 and a motor driving the platen 24 are mounted on the lower unit frame 47. In FIG. 9, the gear 28 and the gear train 29 are eliminated.

In the present embodiment, the printer unit 36 is constituted by these lower unit 48 and upper unit 52.

Figure 10:
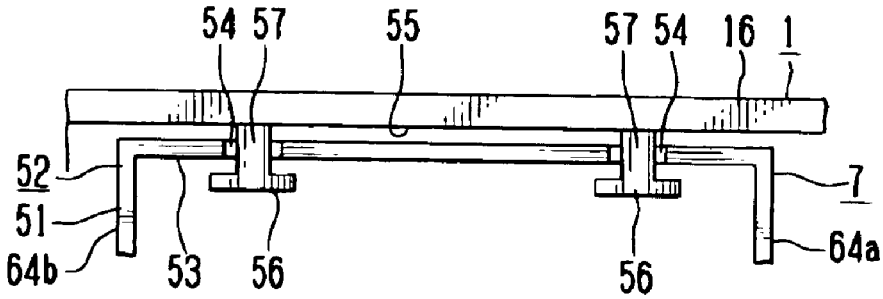
FIG. 10 is a longitudinal front elevational view showing a fixing structure of the upper unit of the receipt printer to the opening/closing cover of ECR.
Figure 11:
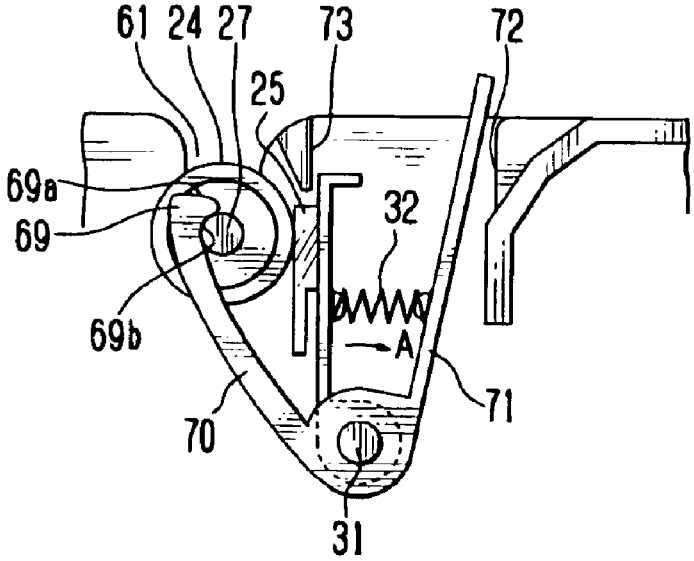
FIG. 11 is a longitudinal left side view showing a fixing structure for a thermal head and a hook member.

In this case, FIG. 10 is a longitudinal front elevational view showing the upper unit fixing structure for the receipt printer 7 for the opening/closing cover 16 of the ECR 1. FIG. 11 is a longitudinal left side view showing the fixing structure for the thermal head 25 and the hook member. As shown in FIG. 10, the upper unit 52 is directly attached in a movable manner to the opening/closing cover 16 of the casing 4. The upper wall 53 of the upper unit frame 51 is formed with two holes 54. The inner surface 55 of the opening/closing cover 16 is formed with two support shafts 57 having a flat-plate like support section 56 at their ends. A diameter of the support shaft 57 is set to be smaller than that of the hole 54 of the upper unit frame 51. The end of the support shaft 57 is provided with a support section 56 and a diameter of the support section 56 is set to be larger than that of the hole 54 of the upper unit frame 51. A length of the support shaft 57 is set to be longer than a plate thickness of the upper unit frame 51. The upper unit frame 51 is held with a clearance with respect to the opening/closing cover 16 by inserting and passing the support shaft 57 into the hole 54 of the upper unit frame 51.

In addition, the upper unit 52 is removably fitted to the lower unit 48 by a connecting mechanism 58. The connecting mechanism 58 is constituted by a connecting shaft 59 and the platen 24 fixed to the lower unit frame 51 of the upper unit 52; a groove 60 formed at the lower unit frame 47 of the lower unit 48 and acting as a first support section to which the connecting shaft 59 can be fitted; and a groove 61 formed at the lower unit frame 47 of the lower unit 48 and acting as a second support section to which both ends of the platen 24 can be fitted.

The connecting shaft 59 is located to the upstream side of the platen 24 in the direction in which the paper is carried. An axial direction of the connecting shaft 59 is in parallel with an axial direction of the platen 24 that corresponds to a paper width direction.

The groove 60 is formed in a pair of inside walls 63*a* and 63*b* formed vertically inside of both sidewalls 62*a* and 62*b* of the lower unit frame 47. The groove 60 is open at the upper part. The groove 61 is formed in the pair of inside walls 63*a* and 63*b* formed vertically inside both side walls 62*a* and 62*b* of the lower unit frame 47, and opens at the upper part.

In the connecting mechanism 58, when the connecting shaft 59 and the support shaft 27 of the platen 24 fit in the grooves 60 and 61, respectively, the upper unit 52 is positioned in relation to the lower unit 48, thereby connecting the upper unit 52 to the lower unit 48. In this state, the upper unit 52 is secured to the lower unit 48 to thereby restrict the movement of the upper unit 52 in relation to the lower unit 48. The support shaft 27 of the platen 24 functions also as a connecting shaft together with the connecting shaft 59. In the state of connection, the platen 24 and the thermal head 25 are oppositely positioned, and the gear 28 mounted on the platen 24 meshes with the gear train 29 as shown in FIG. 4. The movable blade 34 and the stationary blade 33 are positioned at a location in which the paper 23 can be cut.

In the upper unit frame 51, a connecting shaft 65 is disposed. On the lower unit frame 47, a vertical wall 66 is formed. The connecting shaft 65 and the vertical wall 66 are so constructed as to contact with each other when the upper unit 52 and the lower unit 48 are connected. To give a more detailed description, the axis of the connecting shaft 65 is in parallel with the axis of the platen 24, so that the connecting shaft 65 extends sideward from the outer surface of one sidewall 64*a* of the upper unit frame 51. Furthermore, the connecting shaft 65 is installed with its front side in contact with the rear surface of the vertical wall 56 where the upper unit 52 and the lower unit 48 are in a connected state. In the present embodiment, the vertical wall 66 realizes the support section, and the connecting shaft fitted to the support section is realized by the connecting shaft 65. The connecting mechanism 58 is partly constituted of the connecting shaft 65 and the vertical wall 66.

In the present embodiment, the support shaft 27 of the platen 24, the connecting shaft 59, and the connecting shaft 65 realize a plurality of connecting shafts. Also a plurality of support sections are realized by the grooves 60 and 61 and the vertical wall 66.

A clearance between a pair of Inside walls 63*a* and 63*b* formed in the lower unit frame 47 is set narrower than that between both side walls 64*a* and 64*b* of the upper unit frame 51. When the upper unit 52 is connected to the lower unit 48, a pair of inside walls 63*a* and 63*b* of the lower unit frame 47 are inserted between both side walls 64*a* and 64*b* of the upper unit frame 51, thereby guiding the lateral position of the upper unit 52 in relation of the lower unit 48.

FIG. 11 is a longitudinal left side view showing the mounting construction of the thermal head 10 and the hook member. As shown in FIG. 11, a pair of hook members 70 are installed on the lower unit 48. Formed on either of the hook members 70 is a hook portion 69, which can be engaged with, and disengaged from, both support shafts 27 of the platen 24 fitted in the groove 61. The hook member 70 is composed of the hook portion 69 and a flat plate portion 71 formed in a shape of flat plate unitarily with the hook portion 69. The hook member 70 is rotatable about the fulcrum 31 in a direction in which the hook portion 69 is engaged with, and disengaged from, both support shafts 27 of the platen 24. The hook member 70 is being pressed toward engagement with both support shafts 27 of the platen 24 (in the direction of arrow A in FIG. 11) by the coil spring 32 arranged between the hook member 70 and the head holding member 30.

On the hook portion 69, an inclined portion 69*a* and an inclined portion 69*b* are formed. The inclined portion 69*a* is inclined to allow the rotation of the hook member 70 to thereby prevent interference with both support shafts 27 while abutting against both support shafts 27 of the platen 24 when the upper unit 52 is installed to the lower unit 48. The inclined portion 69*b* is inclined to allow the rotation of the hook member 70 to thereby prevent interference with both support shafts 27 while abutting against both support shafts 27 of the platen 24 when removing the upper unit 52 from the lower unit 48.

When the upper unit 52 is connected to the lower unit 48, rotating the hook member 70 against the urging force of the coil spring 32 as the upper unit 52 approaches the lower unit 48 prevents the interference of the hook member 70 with both support shafts 27 of the platen 24. Finally, however, the hook portion 69 is moved to engage with both support shafts 27 of the platen 24 by the biasing force of the coil spring 32, thus locking the upward movement of the upper unit 52 in relation to the lower unit 48.

When the upper unit 52 is removed from the lower unit 48, the interference of the hook member 70 with both support shafts 27 of the platen 24 is prevented by rotating the hook member 70 against the biasing force of the coil spring 32 as the upper unit 52 moves away from the lower unit 48. Finally, the hook member 49 is released in its engagement from both support shafts 27 of the platen 24 and the hook portion 69, whereby the upper unit 52 can be removed from the lower unit 48.

In the state that the upper unit 52 is not connected to the lower unit 48, the hook member 70 being pressed by the coil spring 32 and the head holding member 30 are positioned in contact with each of the positioning surfaces 72 and 73 formed on the lower unit frame 47.

In the state that the upper unit 52 and the lower unit 48 are connected, the connecting shaft 59 is positioned adjacently to the paper guide 19, supporting the paper 23 on the backside. In the receipt printer 7 of the ECR 1 of the present embodiment, a paper smoothing section 74 comprises the aforementioned connecting shaft 59 and the paper guide 19 as shown in FIG. 2. In the paper smoothing section 74, the roll of paper 23 being fed out is sandwiched from above and below between the connecting shaft 59 and the paper guide 19, thus being smoothed. Here, the paper 23 wound in a form of roll tends to curl in the vicinity of the trailing end thereof due to a curling tendency, but can be straightened by passing through the paper smoothing section 74.

Additionally, the ECR 1 is provided with a control section not shown for controlling in driving of each of the segments in it. With such an arrangement as above, it becomes possible to control driving of each of the segments of the ECR 1 and each of the segments of the receipt printer 7. This control section is provided with a PLU (Price Look Up) file having a commodity name or a unit price set for every commodity code. When the commodity code assigned to the commodity is inputted through a bar-code scanner 12 or the keyboard 5, the control section refers to the PLU file, displays the commodity data based on the inputted commodity code on the displays 10, 11 or calculates a total price of all the commodities having the commodity codes inputted therein or displays the calculated total price on the displays 10, 11. In addition, the control section performs an end processing in response to an end operation after the money is given or taken on the basis of the calculated total price. In the present embodiment, the control section performs various kinds of processing on information on the basis of the commodity code. Accordingly, the control section in the present embodiment realizes the commodity information processing.

In such a configuration as above, the receipt printer 7 prints and issues a receipt when information about the commodity is processed. Further, a printing operation performed by the receipt printer 7 is a well-known technology, so that its description will be eliminated.

When the paper 23 is set at the receipt printer 7, at first, the opening/closing cover 16 is opened. With this operation, the upper unit 52 is moved upward along with the opening/closing cover 16. As the upper unit 52 is moved upward, a locked state of the platen 24 with the hook member 70, i.e. the connected state of the connecting mechanism 58 is released. As the opening/closing cover 16 is released, the upper unit 52 having the connected state of the connecting mechanism 58 released is removed from the lower unit 48. Through this operation, the platen 24 and the thermal head 25 are moved away from each other, and also the stationary blade 33 and the movable blade 34 are moved away from each other.

Under this state, the paper 23 is stored in the paper storing section 18 and the paper 23 is pulled out to pass over the main body frame 47 to cause its extremity end to be located at a downstream side in a paper transferring direction rather than the movable blade 34, and then the opening/closing cover 16 is closed. Through this operation, the upper unit 52 is moved to approach the lower unit 48, the connecting shaft 65 abuts against the vertical wall 66 during its motion, the hook member 70 is engaged with the support shaft 27 of the platen 24 and the upper unit 52 is connected to the lower unit 48. In this way, the upper unit 52 and the lower unit 48 are connected to each other to cause the paper 23 to be passed between the connecting shaft 59 and the paper guide 19, between the thermal head 25 and the platen 24 and between the stationary blade 33 and the movable blade 34.

As described above, a setting of the paper 23 to the receipt printer 7 can be easily carried out in the present embodiment because opening of the opening/closing cover 16 causes the printing section 20 to be separated from the cutter section 21 and closing of the opening/closing cover 16 under a state in which the paper 23 is passed between the upper unit 52 and the lower unit 48 enables the paper 23 to be held between the printing section 20 and the cutter section 21.

Figure 13:
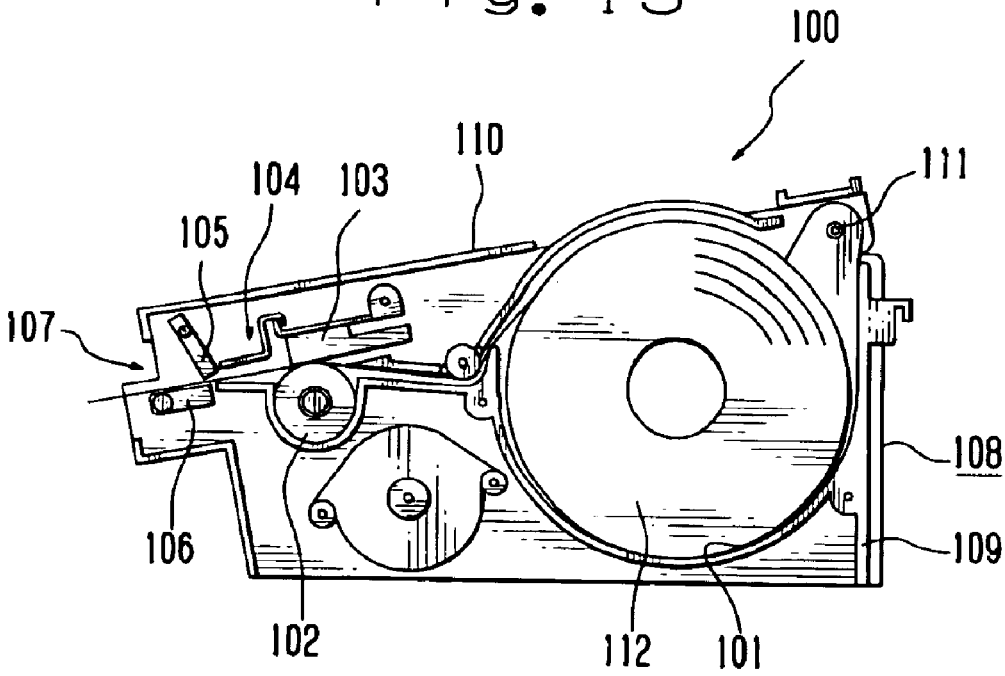
FIG. 13 is a longitudinal side view showing the prior art printer.

In addition, a turning frame as found in the prior art receipt printer shown in FIG. 13 for use in separating the printing section 20 or the cutter section 21 is not needed in the present embodiment, so that a weight of a structure for separating the printing section 20 or the cutter section 21 can be made light.

As described above, the printing operation is a well-known technology and its description is eliminated here. However, when printing, the receipt printer 7 applies a transferring drive force of the platen 24 to the paper 23 stored and held at the paper storing section 18. Then, some predetermined receipt printing contents are printed in sequence by the thermal head 25 when the paper 23 being transferred in the paper-carrying path 22. Upon completion of printing operation, the movable blade 34 is driven in compliance with timing where the rear end in the receipt area already printed passes through the cutter section 21 to cut the paper 23. Then, the cut paper 23 is issued as a receipt.

Thereafter, as a remaining part of the rolled paper 23 decreases with the issue of receipts, the rolled portion of the paper 23 becomes lightweight, and an increased curling tendency appears. In such a case, the paper 23 is likely to move up in the paper holding section 18 to thereby become level and flat on the whole, being fed out in this state. In the present embodiment, however, because of the provision of the paper smoothing section 74, the paper smoothing section 74 smooths the paper 23. In the smoothed state, the paper 23 can be fed into the printing section 20.

In case of jamming of the paper 23 at the paper smoothing section 74, or at the printing section 20, or at the cutter section 21, the upper unit 52 is removed from the lower unit 48 by the same procedure as in the above-described setting of the paper 23. In this state, the space between the connecting shaft 59 and the paper guide 19, the space between the thermal head 25 and the platen 24, and the space between the stationary blade 33 and the movable blade 34 are opened, to thereby enable easy clearance of jams of the paper 23.

In the present embodiment, the provision of the platen 24 and the stationary blade 33 on the upper unit 52 and the provision of the thermal head 25 and the movable blade 34 on the lower unit 48 have been explained as an example. However, it should be noted that the present invention is not limited thereto, and that these members may be installed to the opposite units 48 and 52.

Further in the present embodiment, the provision of the connecting shafts 59 and 65 on the upper unit 52 and the provision of the grooves 60 and 61 and the vertical wall 66 and the paper guide 19 on the lower unit 48 have been explained as an example. However, it should be noted that the present invention is not limited thereto, and that these members may be installed to the opposite units 48 and 52.

As described above, the present embodiment is comprised of a casing 4 having the case 14 and the opening/closing cover 16 which can be separated so as to open or close the inside part through a relative displacement of the opening/closing cover 16 in respect to the case 14; the upper unit 52 fixed to the case 14 while having any one of the platen 24 and the thermal head 25 constituting the printing section 20 to print on the paper 23 at a process where the paper 23 is set in the casing 4 and transferred, and any one of the stationary blade 23 and the movable blade 34 constituting the cutter section 21 for cutting the paper 23; the lower unit 48 directly fixed to the opening/closing cover 16 arranged inside the case 14, removably arranged to the upper unit 52, having the other of the platen 24 and the thermal head 25 and the other of the stationary blade 33 and the movable blade 34, oppositely facing the thermal head 26 and the platen 24 from each other under a closed state of the casing 4, positioning the stationary blade 33 and the movable blade 34 at a location where the paper 23 can be cut and to cause the thermal head 25 and the platen 24 to be moved away from each other under an opened state of the casing 4 and further to cause the stationary blade 33 and the movable blade 34 to be moved away from each other, so that the other of the platen 24 and the thermal head 25 and the other of the stationary blade 33 and the movable blade 34 are arranged at the upper unit 52 to enable each of the thermal head 25 and the platen 24, and each of the stationary blade 33 and the movable blade 34 to be moved toward or moved away from each other through the opening or closing operation of the opening/closing cover 16 with respect to the case 14, and a weight of the structure for use in separating the printing section 20 and the cutter section 21 can be made light.

In addition, in the present embodiment, there is provided the connecting mechanism 58 for position setting the upper unit 52 and the lower unit 48 so as to cause the thermal head 25 and the platen 24 to be oppositely faced to each other under a closed state of the casing 4 and further to enable the upper unit 52 and the lower unit 48 to be position set to cause the stationary blade 33 and the movable blade 34 to be located at a position where the paper 23 can be cut, so that it is possible to perform a positive position setting of the upper unit 52 and the lower unit 48.

In the present embodiment, the connecting mechanism 58 can be constructed by a simple configuration because both a position setting and a fixing of the lower unit 48 to the upper unit 52 are carried out through fitting of a plurality of connecting shafts 27, 59, 65 with a direction crossing at a right angle to the paper carrying direction being applied as an axial direction at any one of the upper unit 52 and the lower unit 48, and a plurality of supporting sections 60, 61, 66 arranged at the other of the upper unit 52 and the lower unit 48, whereby mere opening or closing motion of the opening/closing cover 16 enables the upper unit 52 to be easily engaged to or disengaged from the lower unit 48.

In the present embodiment, even if a fixing position of the opening/closing cover 16 to the case 14 is displaced due to disturbance in manufacturing work or aging, for example, the position of the upper unit 52 in respect to the lower unit 48 can be adjusted under utilization of its clearance and the engagement or disengagement of the upper unit 52 in respect to the lower unit 48 can be carried out through opening or closing operation of the opening/closing cover 16 because the upper unit 52 is not directly connected to the opening/closing cover 16, but is fixed with a clearance to the opening/closing cover 16.

In the present embodiment, the platen 24 has the paper support section 26 supporting the paper 23 and the support shaft 27 extended from both ends of the paper support section 26. The support shaft 27 serves as one of the connecting shafts to enable the cost of the receipt printer to be reduced.

In the present embodiment, the paper guide 19 is provided in either the lower unit 48 or the upper unit 52, on the more upstream side than the platen 24 in the direction of travel of the paper, to support one side of the paper 23. One of the connecting shafts is arranged at any one of the lower unit 48 and the upper unit 52 with a direction crossing at a right angle to the paper feeding direction being applied as an axial direction, the other surface of the paper 23 is supported under a state in which the lower unit 48 and the upper unit 52 are connected by the connecting mechanism 58 and it is oppositely faced to the paper guide 19 in such a manner that the paper 23 can be held between it and the paper guide 19, so that even if the pulling-out portion of the paper is in a roll form due to its curling, it can be smoothed and the paper 23 being smoothed can be transferred to the printing section 20.

In the present embodiment, the lower unit 48 having the movable blade 34 includes the movable blade holding section 41 for holding the movable blade 34. The movable blade 34 can be engaged with or disengaged from the movable blade holding section 41, so that when the movable blade 34 has completed its life time, the movable blade 34 is removed from the rotating shaft 39 to enable only the movable blade 34 to be easily replaced with a new one.

In the present embodiment, there are provided a driving source arranged at the case 14 and for generating a driving force to the platen 24, the thermal head 25 and the movable blade 34, and a driving force transmission mechanism arranged at the case 14 and for transmitting a driving force generated by the driving source to the platen 24, the thermal head 25 and the movable blade 34, so that it is possible to make a light weight driving section and a simple circuit wiring for it as compared with a case where the driving source or the driving force transmitting mechanism is arranged to the opening/closing cover.

Meanwhile, when the cutting operation of the cutter section 21 is to be performed, the movable blade 34 rotated and driven pushes the stationary blade 33. At this time, if it is assumed that the connecting shaft constituting the connecting mechanism 58 is either the connecting shaft 59 or the platen 24, it might be considered that a rotational momentum may act on the upper unit 52 around the platen 24 to cause the upper unit 52 to be turned in respect to the lower unit 48.

On the contrary, in the present embodiment, even if the rotational momentum is generated around the connecting shaft 59 or the platen 24, the upper unit 52 is fixed against the lower unit 48 and a turning of the upper unit 52 in respect to the lower unit 48 is restricted because the connecting shaft is composed of two shafts of the connecting shaft 59 and the platen 24. Accordingly, the upper unit 52 is not rotated by this rotational momentum.

In addition, in the present embodiment, the rotation of the upper unit 52 caused by the rotational momentum acted on the upper unit 52 can be effectively restricted when a cutting operation is carried out at the cutter section 21 in the receipt printer 7 having a higher height size in the present embodiment because the connecting mechanism constituted by the connecting shaft 65 and the vertical wall 66 is installed at a higher position than that of the other connecting mechanism 58. Rotation at the receipt printer 7 showing a larger height size in the present embodiment can be restricted more effectively because the connecting shaft 65 and the vertical wall 66 are arranged at a higher position than that of the other connecting mechanism 58.

Additionally, in the present embodiment, the lower unit 48 acting as a unit having the movable blade 34 has the rotating shaft 39 acting as the movable blade holding section for holding the movable blade 34 and the movable blade 34 can be engaged with or disengaged from the rotating shaft 39. Accordingly, when the movable blade 34 reaches its life time, the movable blade 34 is removed from the rotating shaft 39 to enable only the movable blade 34 to be easily replaced with a new one.

In addition, in the present embodiment, there is provided an ECR 1 acting as a commodity information processing apparatus for processing information about the commodity, including the case 14 and the opening/closing cover 16 for opening or closing the port 14*a* formed at the case 14, wherein the case 14 is applied as a first casing member, the opening/closing cover 16 is applied as a second casing member, there is provided the receipt printer 7 acting as a printer, whereby it is possible to attain the ECR 1 having the same action and effect as that of the receipt printer 7.

Next, referring to FIG. 12, another embodiment of the present invention will be described. The same sections as those of the aforesaid embodiment are denoted by the same reference symbols and their description will be eliminated.

Figure 12:
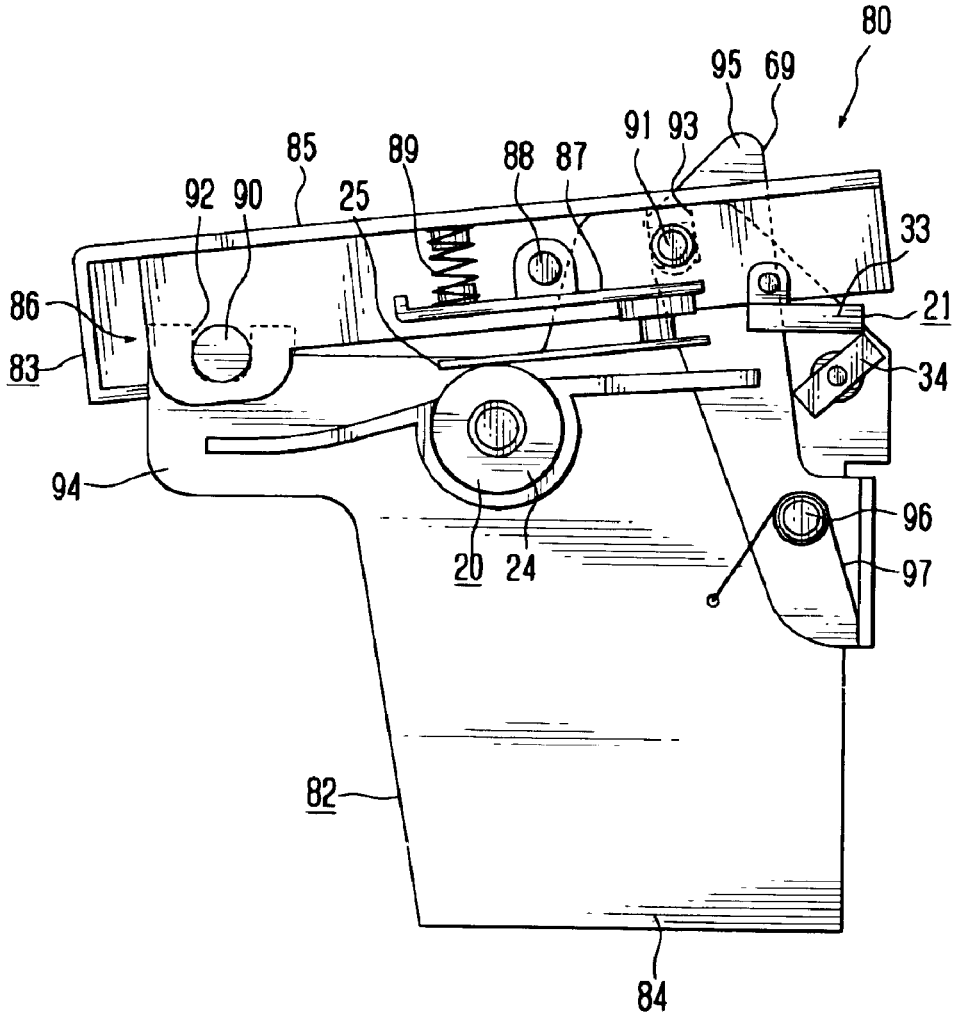
FIG. 12 is a longitudinal left side view showing an upper unit and a lower unit of a second embodiment of the present invention under a state in which they are connected to each other.

FIG. 12 is a longitudinal side view showing a state in which the upper unit and the lower unit of the present embodiment are connected. As shown in FIG. 12, a receipt printer 80 of the present embodiment is different from the aforesaid embodiment in view of its constitutions of a lower unit 82 acting as a first unit and an upper unit 83 acting as a second unit.

More practically, in the case of the receipt printer 80 of the present embodiment, the platen 24 is installed at the lower unit frame 84 to constitute the lower unit 82, and the thermal head 25 is installed at the upper unit frame 85 to constitute the upper unit 83.

The thermal head 25 is mounted to the head holding member 87. The head holding member 87 is arranged to be rotatable in such a direction as one in which it can be moved to or moved away from the platen 24 and it is urged to the platen 24 by the coil spring 89 acting as the compression spring.

The receipt printer 80 of the present embodiment is provided with a connecting mechanism 86 that is different from that of the above-described embodiment. The connecting mechanism 86 is comprised of two connecting shafts 90 and 91 provided in the upper unit frame 85, a groove 92 formed in the lower unit frame 84 as a support section in which both ends of the connecting shaft 90 can be fitted, and a groove 93 formed in the lower unit frame 84 as a support section in which both ends of the connecting shaft 91 can be fitted. The connecting shafts 90 and 91 are mounted at the front and rear of the upper unit frame 85, with their axes directed in parallel with the direction of the axis of the platen 24. The grooves 92 and 93 are formed, open at the upper part, in a pair of inside walls 94 (an inside wall on one side is not shown) formed vertically inside of both side walls (not shown) of the lower unit frame 84.

In the connecting mechanism 86, the upper unit 83 is positioned in relation to the lower unit 82 by fitting the connecting shafts 90 and 91 in the grooves 92 and 93, thus connecting the upper unit 83 to the lower unit 82. In this state, the upper unit 83 is secured to the lower unit 82 to restrict the rotation of the upper unit 83 in relation to the lower unit 82.

On the lower unit 82 a hook member 95 is provided. On the hook member 95 is formed the hook portion 69, which can be engaged with, and disengaged from, the connecting shaft 91 fitted in the groove 93. The hook member 95 is designed in such a manner that the hook 69 is rotatable about a fulcrum 96 toward engagement with, and disengagement from, the connecting shaft 91. The hook member 95 is urged by a spring 97 toward engagement with the connecting shaft 91, functioning similarly to the hook member 70 of the aforesaid embodiment.

Therefore, it is possible to provide the receipt printer unit 80 of the above-described construction that incorporates the plated 24 mounted on the lower unit 82 and the thermal head 25 on the upper unit 83.

Obviously, numerous modifications and variations of the present invention are possible in light of the above teachings. It is therefore understood that within the scope of the appended claims, the invention may be practiced otherwise than as specifically described herein.

What is claimed is:

1. A printer comprising:

a casing having a first casing member and a second casing member provided separably for exposing and covering an inside part of the casing by opening and closing the second casing member with respect to the first casing member;

a guide path arranged in the casing to guide a paper;

a printing section including a platen and a printhead provided on opposite sides of the guide path;

a cutter section which includes a stationary blade and a movable blade provided on opposite sides of the guide path and which cuts a paper printed at the printing section by engaging the movable blade with the stationary blade;

a first unit arranged in the first casing member and located on one side of the guide path and including one of the platen and the printhead and one of the stationary blade and the movable blade;

a second unit directly attached to the second casing member so as to be movable by a predetermined amount with respect to the second casing member, located on the other side of the guide path and having the other one of the platen and the printhead and the other one of the stationary blade and the movable blade, wherein the printhead and the platen are oppositely faced to each other when the casing is closed such that the stationary blade and the movable blade are positioned to cut the paper, and wherein the printhead and the platen are moved away from each other when the easing is open such that the stationary blade and the movable blade are moved away from each other; and a connecting mechanism for removably connecting the second unit to the first unit by position setting the first unit and the second unit such that when the casing is closed, the printhead and the platen are oppositely faced to each other and the stationary blade and the movable blade are positioned to cut the paper.

2. The printer according to claim 1, wherein the connecting mechanism comprises:

a plurality of connecting shafts mounted in one of the first unit and the second unit such that axes thereof are directed orthogonally to a paper transfer direction of the paper along the guide path, and a plurality of support sections provided in the other one of the first unit and the second unit to fit the connecting shafts therein.

3. The printer according to claim 2, wherein the platen comprises a paper support section for supporting the paper, and a supporting shaft extending at both ends of the paper support section so as to be one of the connecting shafts.

4. The printer according to claim 2, further comprising:

a paper guide provided in one of the first unit and the second unit so as to support one side of the paper at an upstream side of the paper transferring direction with respect to the platen;

wherein one of the connecting shafts oppositely faces against the paper guide so as to hold the paper between the one of the connecting shafts and the paper guide when the first unit and the second unit are connected by the connecting mechanism.

5. The printer according to claim 1, further comprising a movable blade holding section provided in one of the first unit and the second unit with the movable blade to removably hold the movable blade.

6. The printer according to claim 1, further comprising:

a driving source provided in the first casing member to generate a driving force for the platen, the printhead and the movable blade; and a driving force transmission mechanism provided in the first casing member to transmit the driving force generated by the driving source to the platen, the printhead and the movable blade.

7. A commodity information processing apparatus, comprising:

a commodity information processing section for processing information concerning a commodity;

a casing having a case and an opening/closing cover which can be separated for exposing and covering an inside part of the casing by opening and closing the opening/closing cover with respect to the case;

a guide path arranged in the casing to guide a paper;

a printing section including a platen and a printhead provided on opposite sides of the guide path;

a cutter section which includes a stationary blade and a movable blade provided on opposite sides of the guide path and which cuts a paper printed at the printing section by engaging the movable blade with the stationary blade;

a first unit arranged in the case and located on one side of the guide path and including one of the platen and the printhead and one of the stationary blade and the movable blade;

a second unit directly attached to the opening/closing cover so as to be movable by a predetermined amount with respect to the opening/closing cover, located on the other side of the guide path and having the other one of the platen and the printhead and the other one of the stationary blade and the movable blade, wherein the printhead and the platen are oppositely faced to each other when the casing is closed such that the stationary blade and the movable blade are positioned to cut the paper, and wherein the printhead and the platen are moved away from each other when the casing is open such that the stationary blade and the movable blade are moved away from each other; and a connecting mechanism for removably connecting the second unit to the first unit by position setting the first unit and the second unit such that when the casing is closed the printhead and the platen are oppositely faced to each other and the stationary blade and the movable blade are positioned to cut the paper.

8. The commodity information processing apparatus according to claim 7, wherein the connecting mechanism comprises:

a plurality of connecting shafts mounted in one of the first unit and the second unit such that axes thereof are directed orthogonally to a paper transfer direction of the paper along the guide path, and a plurality of support sections provided in the other one of the first unit and the second unit to fit the connecting shafts therein.

9. The commodity information processing apparatus according to claim 8, wherein the platen comprises a paper support section for supporting the paper, and a supporting shaft extending at both ends of the paper support section so as to be one of the connecting shafts.

10. The commodity information processing apparatus according to claim 8, further comprising:

a paper guide provided in one of the first unit and the second unit so as to support one side of the paper at an upstream side of the paper transferring direction with respect to the platen;

wherein one of the connecting shafts oppositely faces against the paper guide so as to hold the paper between the one of the connecting shafts and the paper guide when the first unit and the second unit are connected by the connecting mechanism.

11. The commodity information processing apparatus according to claim 7, further comprising a movable blade holding section provided in one of the first unit and the second unit with the movable blade to removably hold the movable blade.

12. The commodity information processing apparatus printer according to claim 7, further comprising:

a driving source provided in the case to generate a driving force for the platen, the printhead and the movable blade; and a driving force transmission mechanism provided in the case to transmit the driving force generated by the driving source to the platen, the printhead and the movable blade.

* * * * *

US006899479C1

(12) EX PARTE REEXAMINATION CERTIFICATE (5999th)

United States Patent
Hayashi et al.

(10) Number: US 6,899,479 C1
(45) Certificate Issued: Nov. 6, 2007

(54) PRINTER AND COMMODITY INFORMATION PROCESSING APPARATUS

(75) Inventors: Katsumune Hayashi, Suntou-gun (JP); Hiroyuki Koyama, Mishima (JP); Kouichi Yamada, Tagata-gun (JP)

(73) Assignee: Toshiba Tec Kabushiki Kaisha, Chiyoda-Ku, Tokyo (JP)

Reexamination Request:
No. 90/008,025, May 9, 2006

Reexamination Certificate for:

| | |
|---|---|
| Patent No.: | **6,899,479** |
| Issued: | **May 31, 2005** |
| Appl. No.: | **10/660,028** |
| Filed: | **Sep. 11, 2003** |

(30) Foreign Application Priority Data

Sep. 12, 2002 (JP) ..... 2002-267213

(51) Int. Cl.

| | |
|---|---|
| ***B26D 1/01*** | (2006.01) |
| ***B26D 1/38*** | (2006.01) |
| ***B26D 7/26*** | (2006.01) |
| ***B41J 15/04*** | (2006.01) |
| ***B41J 11/70*** | (2006.01) |
| ***B41J 3/44*** | (2006.01) |
| ***B41J 3/46*** | (2006.01) |

(52) U.S. Cl. ..... 400/621; 400/605; 400/691; 400/690.4

(58) Field of Classification Search ..... None
See application file for complete search history.

(56) References Cited

U.S. PATENT DOCUMENTS

| | | | |
|---|---|---|---|
| 5,137,385 | A | 8/1992 | Kamimura et al. |
| 5,833,380 | A | 11/1998 | Hosomi et al. |
| 5,902,059 | A | 5/1999 | Asai et al. |
| 6,361,231 | B1 | 3/2002 | Sato et al. |
| 6,443,645 | B1 | 9/2002 | Takei et al. |
| 6,447,187 | B1 | 9/2002 | Robinson |
| 6,508,600 | B1 | 1/2003 | Nonaka |

FOREIGN PATENT DOCUMENTS

| | | | |
|---|---|---|---|
| JP | 11-245476 | A | 9/1999 |
| JP | 2000-272200 | A | 10/2000 |
| JP | 2001-121764 | A | 5/2001 |
| JP | 2002-193476 | A | 7/2002 |

*Primary Examiner*—David E Harvey

(57) ABSTRACT

A printer comprising a printing section that has a platen, a cutter section with a stationary blade and a movable blade and a printhead located oppositely on both sides of the guide path. A first unit is located on one side of the guide path arranged inside the casing which can be separated into a first casing member and a second casing member, holding either one of the stationary blade and the movable blade in the cutter section and a second unit located on the other side of the guide path that has either one of the other platen and the other printhead and either one of the stationary blade and the other movable blade.

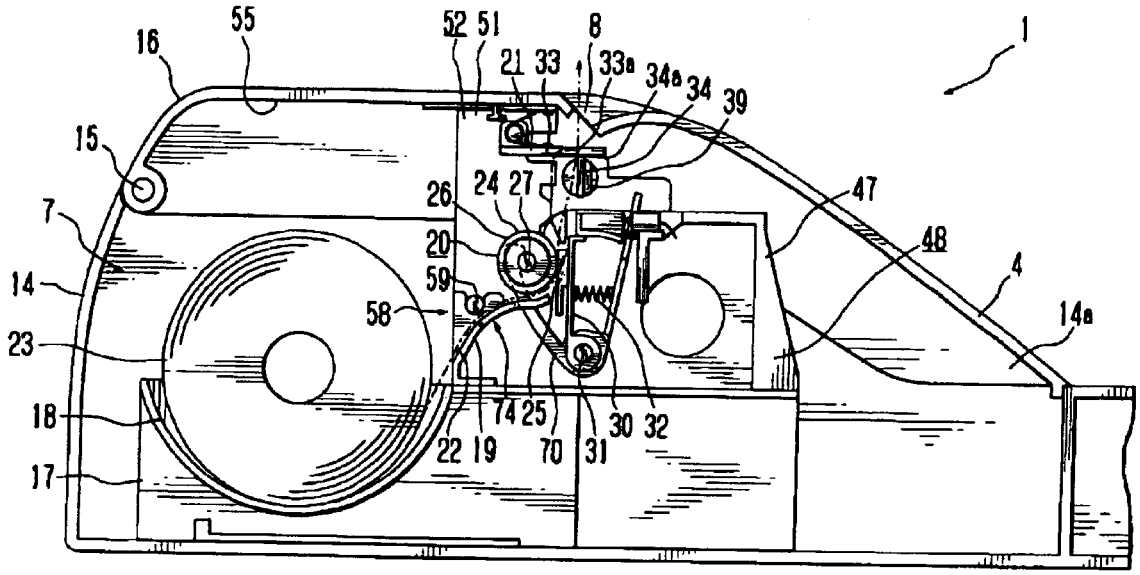

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 7 are determined to be patentable as amended.

Claims 2–6, 8–11 and 12, dependent on an amended claim, are determined to be patentable.

1. A printer comprising:

a casing having a first casing member and a second casing member provided separably for exposing and covering an inside part of the casing by opening and closing the second casing member with respect to the first casing member;

a guide path arranged in the casing to guide a paper;

a printing section including a platen and a printhead provided on opposite sides of the guide path;

a cutter section which includes a stationary blade and a movable blade provided on opposite sides of the guide path and which cuts a paper printed at the printing section by engaging the movable blade with the stationary blade;

a first unit arranged in the first casing member and located on one side of the guide path and including one of the platen and the printhead and one of the stationary blade and the movable blade;

a second unit directly attached to the second casing member so as to be movable by a predetermined amount with respect to the second casing member, located on the other side of the guide path and having the other one of the platen and the printhead and the other one of the stationary blade and the movable blade, wherein the printhead and the platen are oppositely faced to each other when the casing is closed such that the stationary blade and the movable blade are positioned to cut the paper, and wherein the printhead and the platen are moved away from each other when the [easing] *casing* is open such that the stationary blade and the movable blade are moved away from each other; and a connecting mechanism for removably connecting the second unit to the first unit by position setting the first unit and the second unit such that when the casing is closed, the printhead and the platen are oppositely faced to each other and the stationary blade and the movable blade are positioned to cut the paper*;*

*wherein the second unit comprises a unit frame including an upper wall with a plurality of holes formed therein, and the second casing member comprises a plurality of support shafts which are respectively inserted in the plurality of holes in the upper wall of the unit frame of the second unit; and*

*wherein a diameter of each of the support shafts is smaller than a diameter of one of the holes in which the support shaft is inserted, and wherein an inserted end of each of the support shafts that is inserted through one of the holes comprises a support section that has a diameter that is larger than the diameter of the one of the holes in which the support shaft is inserted.*

7. A commodity information processing apparatus, comprising:

a commodity information section for processing information concerning a commodity;

a casing having a case and an opening/closing cover which can be separated for exposing and covering an inside part of the casing by opening and closing the opening/closing cover with respect to the case; a guide path arranged in the casing to guide a paper; a printing section including a platen and a printhead provided on opposite sides of the guide path;

a cutter section which includes a stationary blade and a movable blade provided on opposite sides of the guide path and which cuts a paper printed at the printing section by engaging the movable blade with the stationary blade;

a first unit arranged in the case and located on one side of the guide path and including one of the platen and the printhead and one of the stationary blade and the movable blade;

a second unit directly attached to the opening/closing cover so as to be movable by a predetermined amount with respect to the opening/closing cover, located on the other side of the guide path and having the other one of the platen and the printhead and the other one of the stationary blade and the movable blade, wherein the printhead and the platen are oppositely faced to each other when the casing is closed such that the stationary blade and the movable blade are positioned to cut the paper, and wherein the printhead and the platen are moved away from each other when the casing is open such that the stationary blade and the movable blade are moved away from each other; and a connecting mechanism for removably connecting the second unit to the first unit by position setting the first unit and the second unit such that when the casing is closed the printhead and the platen are oppositely faced to each other and the stationary blade and the movable blade are positioned to cut the paper*;*

*wherein the second unit comprises a unit frame including an upper wall with a plurality of holes formed therein, and the opening/closing cover comprises a plurality of support shafts which are respectively inserted in the plurality of holes in the upper wall of the unit frame of the second unit; and*

*wherein a diameter of each of the support shafts is smaller than a diameter of one of the holes in which the support shaft is inserted, and wherein an inserted end of each of the support shafts that is inserted through one of the holes comprises a support section that has a diameter that is larger than the diameter of the one of the holes in which the support shaft is inserted.*

* * * * *